US007891021B2

(12) United States Patent
Grilliot et al.

(10) Patent No.: US 7,891,021 B2
(45) Date of Patent: Feb. 22, 2011

(54) PROTECTIVE GARMENT HAVING TWO SLEEVES, EACH ATTACHED SO AS TO EXTEND IN A FORWARD DIRECTION WHEN UNSTRESSED

(75) Inventors: William L. Grilliot, Dayton, OH (US); Mary I. Grilliot, Dayton, OH (US); Patricia K. Waters, Tipp City, OH (US); William L. Grilliot, Jr., Dayton, OH (US); James H. Lewis, West Carrollton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 190 days.

(21) Appl. No.: 12/148,653

(22) Filed: Apr. 21, 2008

(65) Prior Publication Data

US 2009/0260125 A1 Oct. 22, 2009

(51) Int. Cl.
*A62B 17/00* (2006.01)

(52) U.S. Cl. ..... 2/81

(58) Field of Classification Search ..... 2/81, 2/69, 93, 125, 59, 85, 108

See application file for complete search history.

(56) References Cited

U.S. PATENT DOCUMENTS

| | | | | | |
|---|---|---|---|---|---|
| 4,507,808 | A | * | 4/1985 | Montalto | 2/93 |
| 4,627,112 | A | * | 12/1986 | Grilliot et al. | 2/81 |
| 4,864,655 | A | * | 9/1989 | McKenney et al. | 2/93 |
| 5,010,591 | A | * | 4/1991 | Kalaam | 2/93 |
| 5,031,242 | A | * | 7/1991 | Aldridge et al. | 2/81 |
| 5,165,110 | A | * | 11/1992 | Grilliot et al. | 2/93 |
| 5,410,759 | A | * | 5/1995 | Hari | 2/108 |

* cited by examiner

*Primary Examiner*—Tejash Patel
(74) *Attorney, Agent, or Firm*—Wood, Phillips, Katz, Clark & Mortimer

(57) ABSTRACT

A protective garment of a type preferably conforming to at least one NFPA standard and worn by firefighters and by emergency rescue workers has a body, which has two sleeve mouths, and has two sleeves. Each sleeve is attached to the body by being sewn thereto, along and around a margin of an associated one of the sleeve mouths, so as to extend in a forward direction when unstressed. The forward direction may be a forward and downward direction, a forward and upward direction, or a forward and lateral direction. The protective garment may be a protective coat, a protective jacket, a protective shirt, or a suit of protective coveralls.

3 Claims, 2 Drawing Sheets

PROTECTIVE GARMENT HAVING TWO SLEEVES, EACH ATTACHED SO AS TO EXTEND IN A FORWARD DIRECTION WHEN UNSTRESSED

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention pertains to a protective garment, such as a protective coat, a protective jacket, a protective shirt, or a suit of protective coveralls, which has a body and two sleeves. This invention contemplates that each of the sleeves is attached to the body so as to extend in a forward direction when unstressed.

BACKGROUND OF THE INVENTION

Typically, a protective garment of a type worn by firefighters and by emergency rescue workers conforms to one or more National Fire Protection Association (NFPA) standards, for example as exemplified in any editions of NFPA 1971; NFPA 1976; NFPA 1951 USAR; NFPA 1977; NFPA 1999 EMS; and/or NFPA 1991, 1992, 1994 HAZMAT; the disclosures of which are incorporated herein by reference. If the protective garment is a protective coat, a protective jacket, or a suit of protective coveralls, the protective garment has a body and two sleeves.

An example of a protective coat of the type noted above, wherein each of the sleeves is attached by being sewn to the body so as to extend in an upward and lateral direction when unstressed, is disclosed in U.S. Pat. No. 5,165,110, the disclosure of which is incorporated herein by reference. As disclosed in U.S. Pat. No. 5,165,110, stress upon a wearer as a result of arm movement is minimal. A protective coat of related interest is disclosed in U.S. Pat. No. 5,010,591.

SUMMARY OF THE INVENTION

This invention provides a protective garment of a type worn by firefighters and by emergency rescue workers. The protective garment has a body, which has two sleeve mouths, and has two sleeves. Preferably, the protective garment conforms to the current edition of at least one of NFPA 1971; NFPA 1975; NFPA 1951 USAR; NFPA 1977; NFPA 1999 EMS; NFPA 1991, 1992, 1994 HAZMAT; and/or NFPA 1971. Each of the sleeves is attached to the body, preferably by being sewn to the body, along and around a margin of an associated one of the sleeve mouths, so as to extend in a forward direction when unstressed. The forward direction may be a forward and downward direction, a forward and upward direction, or a forward and lateral direction.

Other objects, features, and advantages of the invention will become apparent from a review of the entire specification, including the appended claims and drawings.

DETAILED DESCRIPTION OF THE PREFERRED EMBODIMENT

Figure 1:
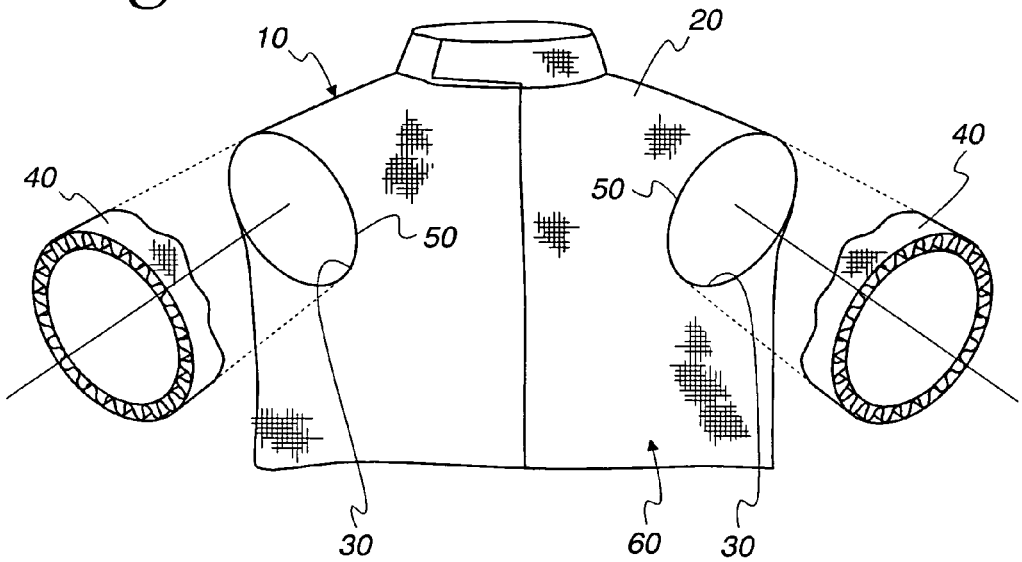
FIGS. 1, 2, and 3, respectively, are fragmentary, perspective, front views of three embodiments of this invention in a protective garment, such as a protective coat, a protective jacket, or a suit of protective coveralls. In each of these embodiments, a body of the protective garment is illustrated as flattened, while each of two sleeves of the protective garment is illustrated as being sewn to the body of the protective garment so as to extend in a forward direction when unstressed.

As illustrated, a protective garment 10 of a type worn by firefighters and by emergency rescue workers conforms to one or more National Fire Protection Association (NFPA) standards, as exemplified by NFPA 1971; NFPA 1976; NFPA 1951 USAR; NFPA 1977; NFPA 1999 EMS; NFPA 1991, 1992, 1994 HAZMAT; and has an outer shell, an intermediate liner providing a moisture barrier, and an inner liner providing a thermal barrier. To simplify the drawings, only the outer shell is illustrated. The protective garment 10 has a body 20, which has two sleeve mouths 30, and two sleeves 40, each of which is attached to the body 20 by being sewn to the body 20 along and around a margin 50 of an associated one of the sleeve mouths 30.

As contemplated by this invention, the sleeve mouths 30 are configured so that, when each sleeve 40 is attached to the body 20 by being sewn to the body 20 along and around the margin 50 of the associated one of the sleeve mouths 30, said sleeve 40 extends in a forward direction when said sleeve 40 is unstressed. The forward direction may be a forward and downward direction, as in the embodiment of FIG. 1, a forward and upward direction, as in the embodiment of FIG. 2, or a forward and lateral direction, as in the embodiment of FIG. 3.

Figure 2:
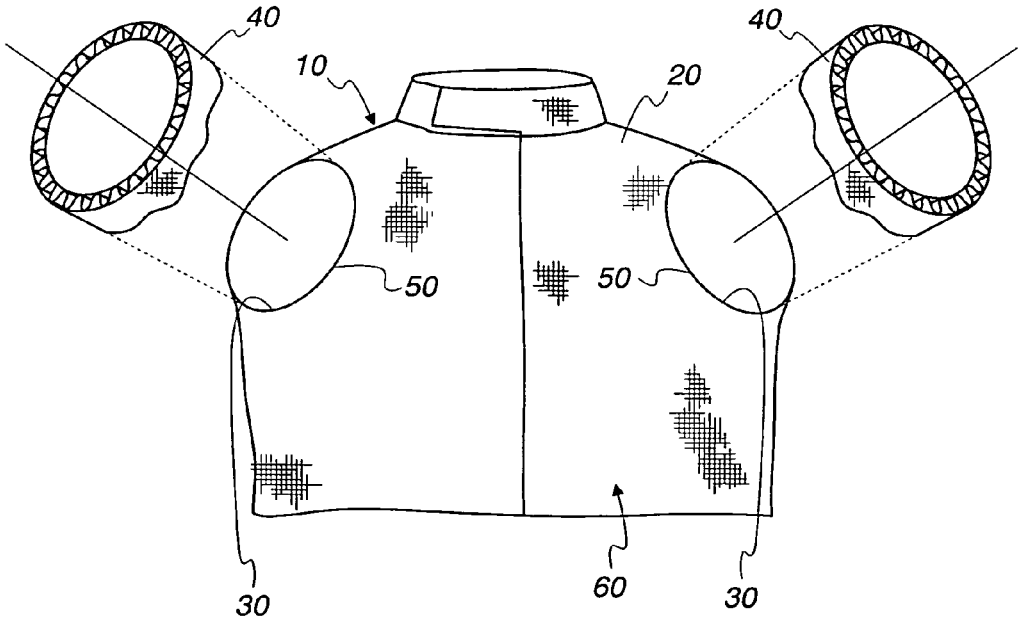
Figure 3:
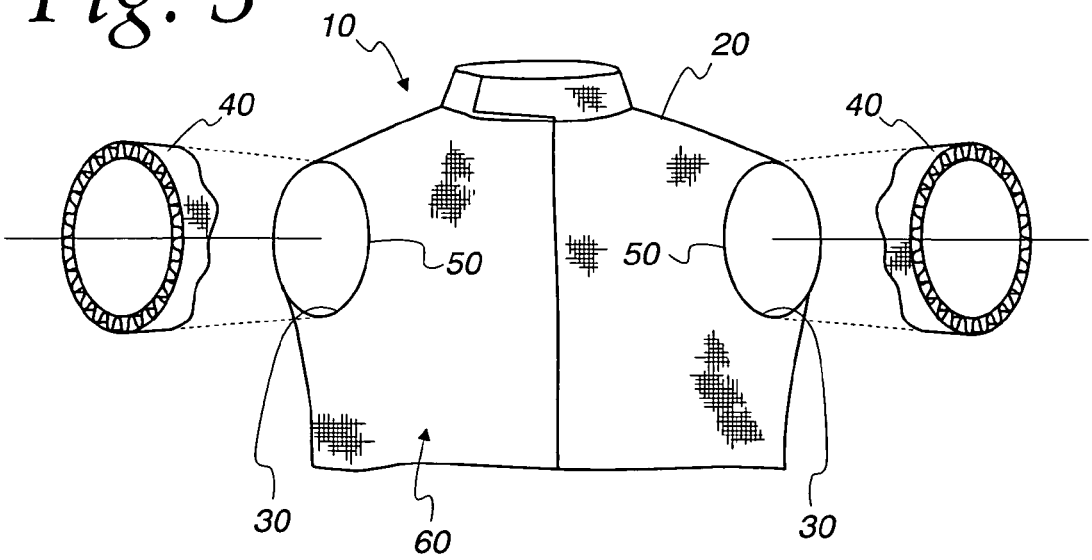

Advantageously, the embodiment of FIG. 2, in which each sleeve 40 extends in a forward and upward direction when said sleeve 40 is unstressed, also includes the subject matter of U.S. Pat. No. 5,165,110, supra.

Figure 4:
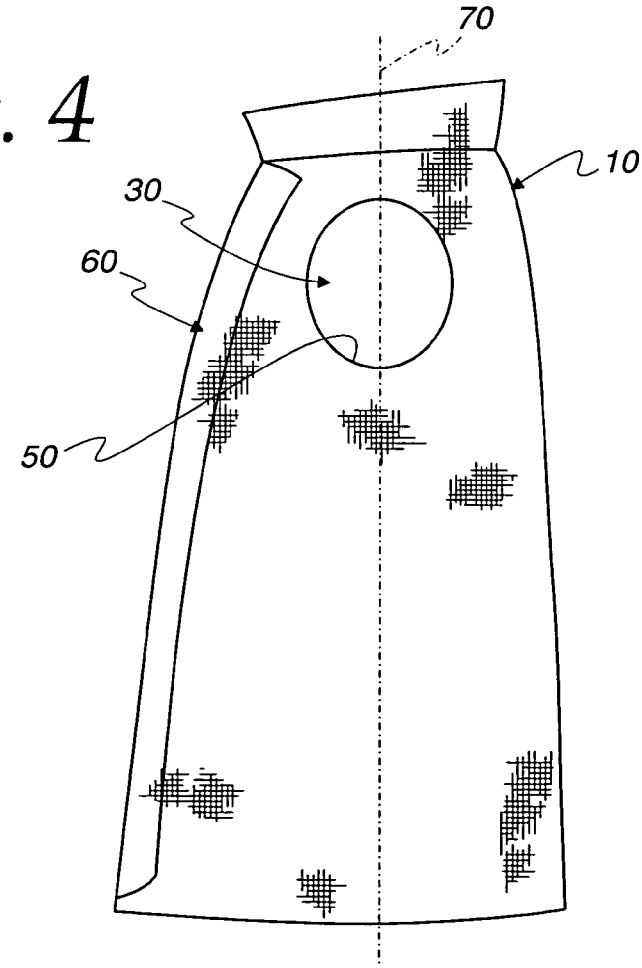
FIG. 4 is a fragmentary side view of the garments of FIGS. 1-3 with the left-hand sleeve not shown.

As best seen in FIG. 4, a majority of each of the margins 50 of each of the sleeve mouths 30 is located on the anterior (front) side 60 of a coronal plane 70, as defined by a wearer of the garment 10 in the unstressed condition of the garment 10.

It should be appreciated that while the invention described herein is particularly useful in protective garments of the type worn by firefighter's and/or emergency rescue workers, the invention may prove useful and be incorporated in other garments, including jackets, shirts, and coveralls and such for casual, sport and other type wear.

Hereinbefore and in the claims, all directions are referred to the protective garment, as the protective garment would be oriented if the protective garment were worn by an erectly standing wearer who was not stressing the sleeves. Hereinbefore, all references to a sleeve being unstressed refer to the sleeve being unstressed by a wearer, gravitationally, or otherwise.

The invention claimed is:

1. A protective garment of a type worn by firefighters and by emergency rescue workers, the protective garment having a body, which has two sleeve mouths, the protective garment having two sleeves, each of which is attached to the body, along and around a margin of an associated one of the sleeve mouths, a majority of each margin being located on the anterior side of a coronal plane as defined by a wearer of the protective garment with the garment in an unstressed condition.

2. The protective garment of claim 1, wherein each sleeve is attached to the body, by being sewn to the body.

3. The protective garment of claim 1, wherein the protective garment conforms to at least one of NFPA 1971; NFPA 1975; NFPA 1951 USAR; NFPA 1977; NFPA 1999 EMS; NFPA 1991, 1992, 1994 HAZMAT.

* * * * *